US008147087B2

(12) United States Patent
Chen

(10) Patent No.: US 8,147,087 B2
(45) Date of Patent: Apr. 3, 2012

(54) MAGNETIC ILLUMINATION DEVICE FOR TOOL

(76) Inventor: Ming-Nan Chen, Taichung (TW)

( * ) Notice: Subject to any disclaimer, the term of this patent is extended or adjusted under 35 U.S.C. 154(b) by 288 days.

(21) Appl. No.: 12/648,284

(22) Filed: Dec. 28, 2009

(65) Prior Publication Data

US 2011/0157881 A1 Jun. 30, 2011

(51) Int. Cl.
*F21L 4/02* (2006.01)

(52) U.S. Cl. ..... 362/184; 362/249.01

(58) Field of Classification Search ..... 362/102, 362/109, 119, 120, 184, 191, 249.01
See application file for complete search history.

(56) References Cited

U.S. PATENT DOCUMENTS

| | | | | |
|---|---|---|---|---|
| 7,066,615 | B2 * | 6/2006 | Diggle et al. | 362/120 |
| 2006/0256547 | A1 * | 11/2006 | Huang | 362/119 |
| 2007/0014108 | A1 * | 1/2007 | Uke | 362/191 |
| 2008/0144309 | A1 * | 6/2008 | Nagata et al. | 362/120 |
| 2010/0139007 | A1 * | 6/2010 | Anderson et al. | 7/118 |

* cited by examiner

*Primary Examiner* — David V Bruce
(74) *Attorney, Agent, or Firm* — Raymond Y. Chan; David and Raymond Patent Firm

(57) ABSTRACT

An illumination device in one embodiment includes a housing comprising a bottom cavity; a battery powered light emitting assembly disposed in the housing and comprising an exposed light source; and a magnetic assembly comprising two separate magnetic members each having an inner inclined flat surface, the magnetic members being secured to the cavity. The illumination device is adapted to releasably secure to one of a variety of tools or a metal object.

12 Claims, 11 Drawing Sheets

MAGNETIC ILLUMINATION DEVICE FOR TOOL

BACKGROUND OF THE INVENTION

1. Field of Invention

The invention relates to illumination devices and more particularly to such an illumination device having a magnetic arrangement adapted to releasably secure to one of a variety of tools or a metal object.

2. Description of Related Art

It is often that a user may use a tool to work in a dark environment. Hence, an auxiliary illumination device (e.g., flashlight) is required to illuminate a working area of the tool (e.g., screw driver) held by a user. The user has to use one hand to hold the flashlight and the other hand to hold the screw driver to work. This is inconvenient and can hinder work.

Taiwanese Utility Model Patent Nos. 309,642 and 484,492 each discloses an illumination device releasably mounted on a tool (e.g., screw driver) so that a user can use the screw driver in a dark environment. However, the illumination devices of the prior patents are not adaptable. In brief, they are designed to cooperate with one type of tool only. Thus, a need for improvement exists.

SUMMARY OF THE INVENTION

It is therefore one object of the invention to provide an illumination device having a magnetic arrangement adapted to releasably secure to one of a variety of tools or a metal object.

In one aspect of the invention there is provided an illumination device comprising a housing comprising a bottom cavity; a battery powered light emitting assembly disposed in the housing and comprising an exposed light source; and a magnetic assembly comprising two separate magnetic members each having an inner inclined flat surface, the magnetic members being secured to the cavity.

In another aspect of the invention there is provided an illumination device comprising a housing comprising a bottom cavity; a battery powered light emitting assembly disposed in the housing and comprising an exposed light source; and a magnetic assembly secured to the cavity.

In a further aspect of the invention there is provided an illumination device comprising a housing comprising a magnetic bottom cavity; and a battery powered light emitting assembly disposed in the housing and comprising an exposed light source.

Preferably, the cavity has an inverted V-shape.

Preferably, the light source comprises a plurality of LEDs (light-emitting diodes).

Preferably, the inner inclined flat surface of each magnetic member has a flat end, the magnetic assembly has two flat ends, or the cavity has two flat ends for a stable placement on a flat surface.

The above and other objects, features and advantages of the invention will become apparent from the following detailed description taken with the accompanying drawings.

DETAILED DESCRIPTION OF THE INVENTION

Figure 1:
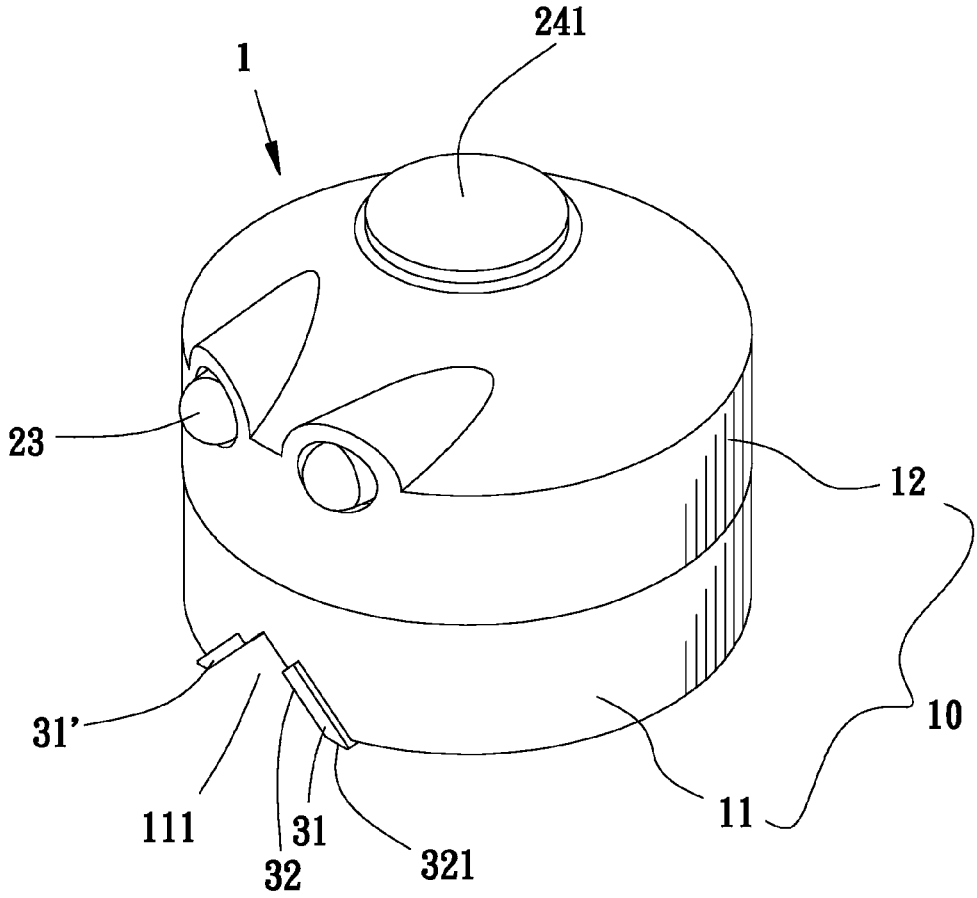
FIG. 1 is a perspective view of a first preferred embodiment of illumination device for tool according to the invention.
Figure 2:
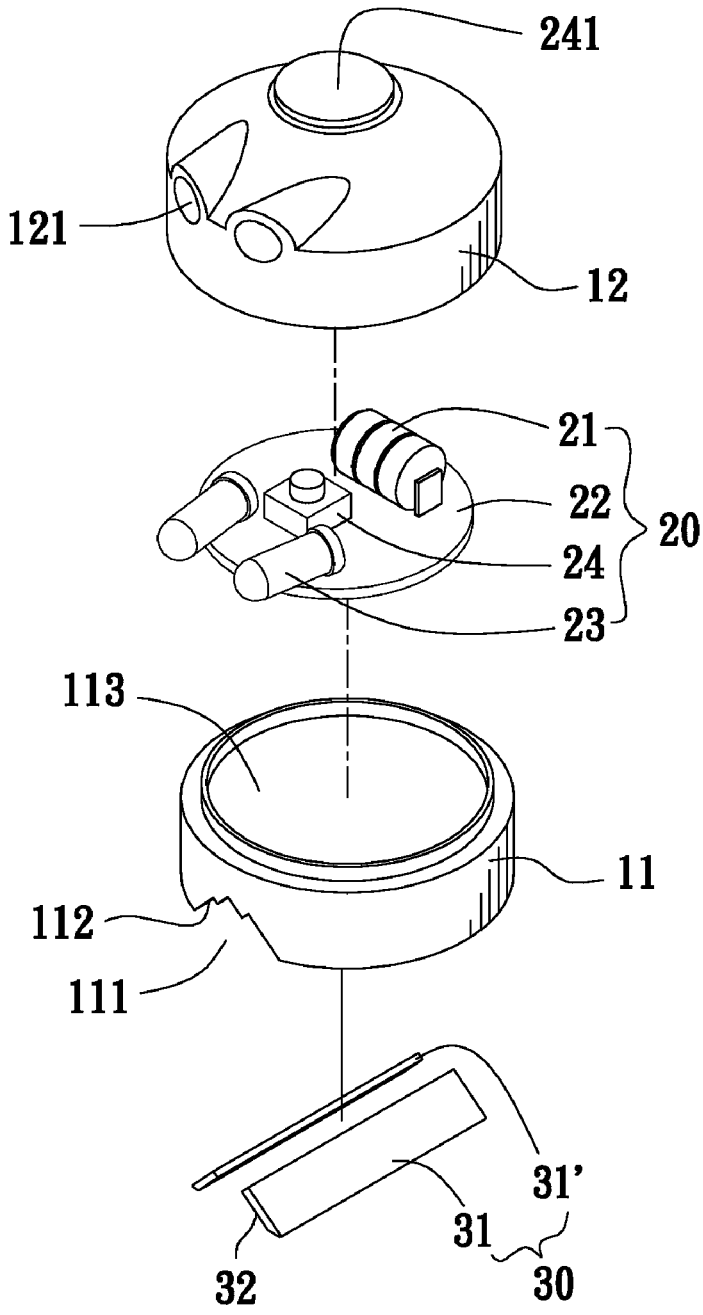
FIG. 2 is an exploded view of the illumination device shown in FIG. 1.
Figure 3:
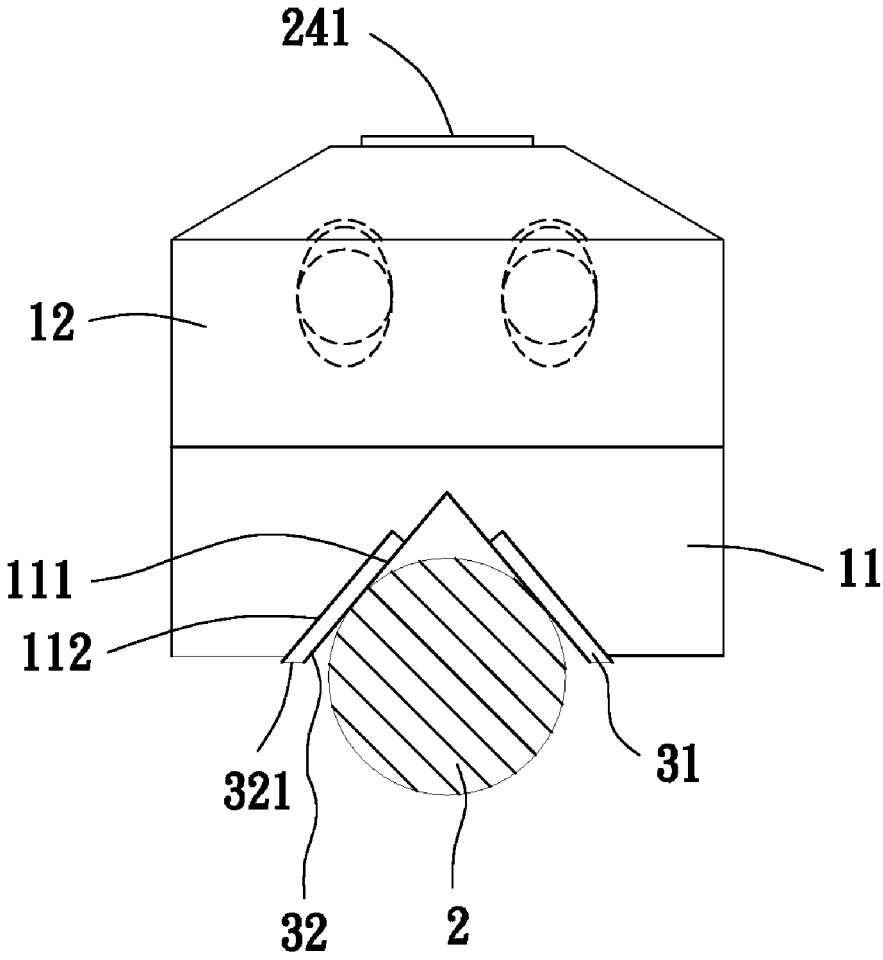
FIG. 3 is a longitudinal sectional view of the illumination device shown in FIG. 1 where a first type of screw driver is secured to the illumination device.

Referring to FIGS. 1 to 4, an illumination device 1 for tool in accordance with a first preferred embodiment of the invention comprises the following components as discussed in detail below.

A cylindrical housing 10 comprises a base 11 and a cover 12 releasably secured together. An internal space 113 employed as a battery compartment is defined by the base 11. The base 11 comprises a substantially inverted V-shaped cavity 111 on the bottom edge, the cavity 111 having two opposite recesses 112 on both inclined sides. The cover 12 comprises two forward holes 121 on a top edge and an opening (not numbered) on a top center.

A light emitting assembly 20 is provided in the housing 10 and comprises a circular printed circuit board (PCB) 22, three cells 21 connected serially on the PCB 22 and electrically connected thereto, a switch 24 provided on a top center of the PCB 22 and having a depressible push button 241 projecting out of the opening of the cover 12 for on/off operation of the switch 24, and two cylindrical LEDs (light-emitting diodes) 23 provided on the PCB 22 and electrically connected thereto. The LEDs 23 have open ends slightly projecting out of the holes 121 and retained therein.

A magnetic assembly 30 comprises two separate magnetic members 31, 31' substantially having an elongated rectangular shape. Each magnetic member, for example, the magnetic member 31 has an inner inclined flat surface 32 with a flat bottom 321. The magnetic members 31, 31' are secured to the complimentary recesses 112 so that a perfect inverted V is formed by the cavity 111.

Figure 4:
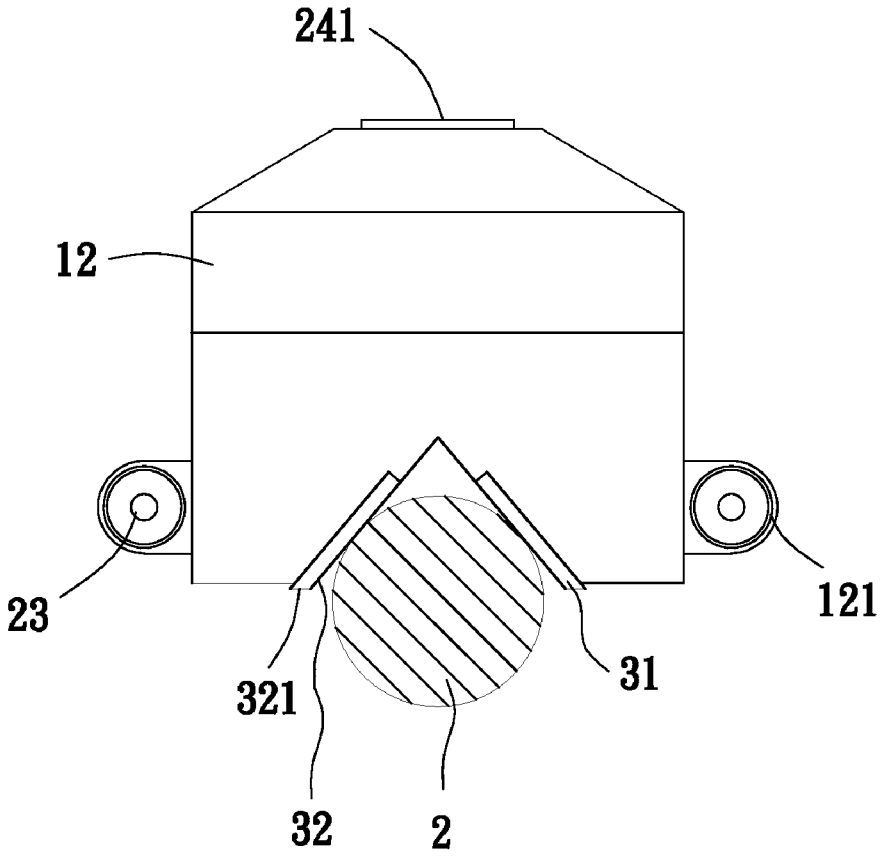
FIG. 4 is a view similar to FIG. 3 where another configuration of the holes with LEDs disposed therein is shown.

Alternatively, in another configuration of the illumination device 1 the holes 121 are provided oppositely on the outer surface of the base 11 with the LEDs 23 disposed therein as shown in FIG. 4.

In use, a user may magnetic adhere the magnetic surfaces 32 to the shank of a screw driver 2. Thereafter, the user may press the push button 241 to open the switch 24. As a result, the LEDs 23 are activated to emit light rays to illuminate a working area pointed by the screw driver 2.

It is envisaged by the invention that screw drivers having different shank diameters can be magnetically fastened by the illumination device.

Figure 5:
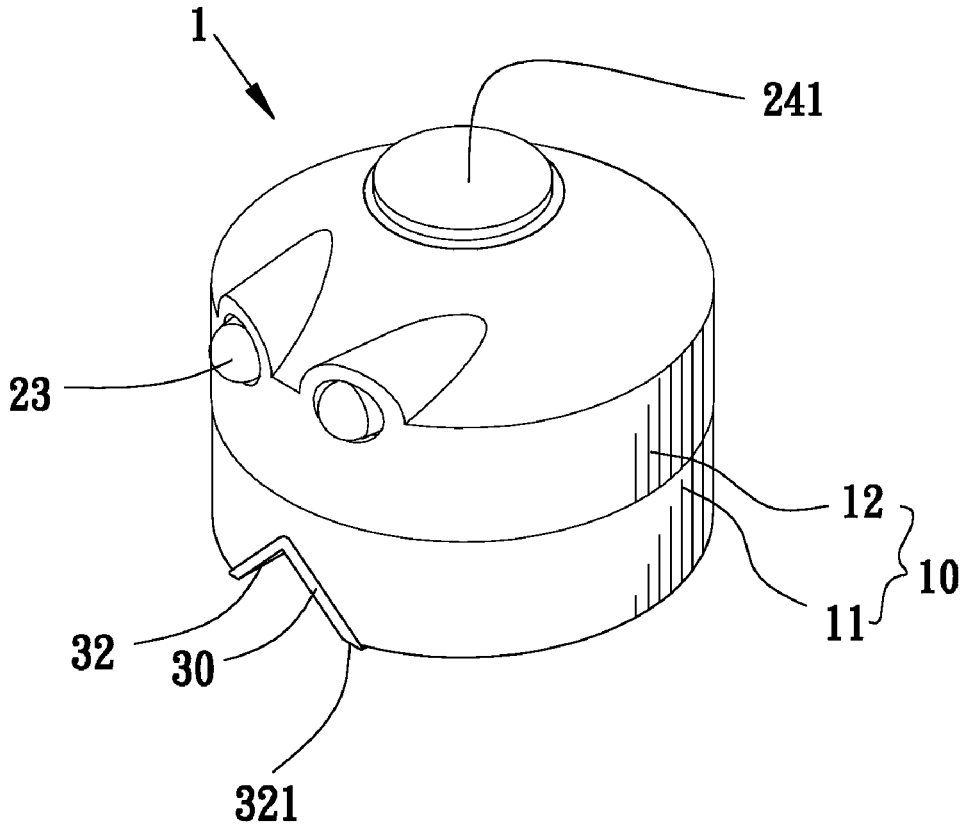
FIG. 5 is a perspective view of a second preferred embodiment of illumination device for tool according to the invention.
Figure 6:
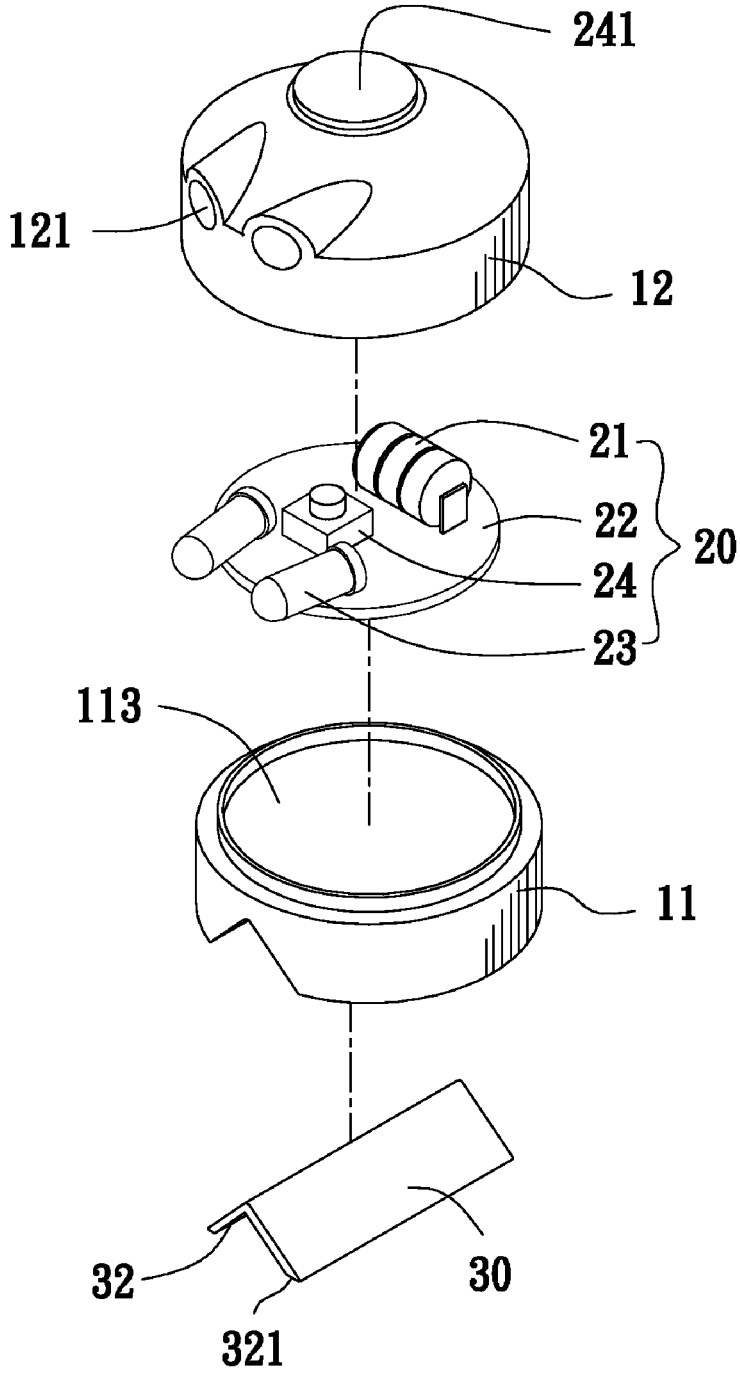
FIG. 6 is an exploded view of the illumination device shown in FIG. 5.
Figure 7:
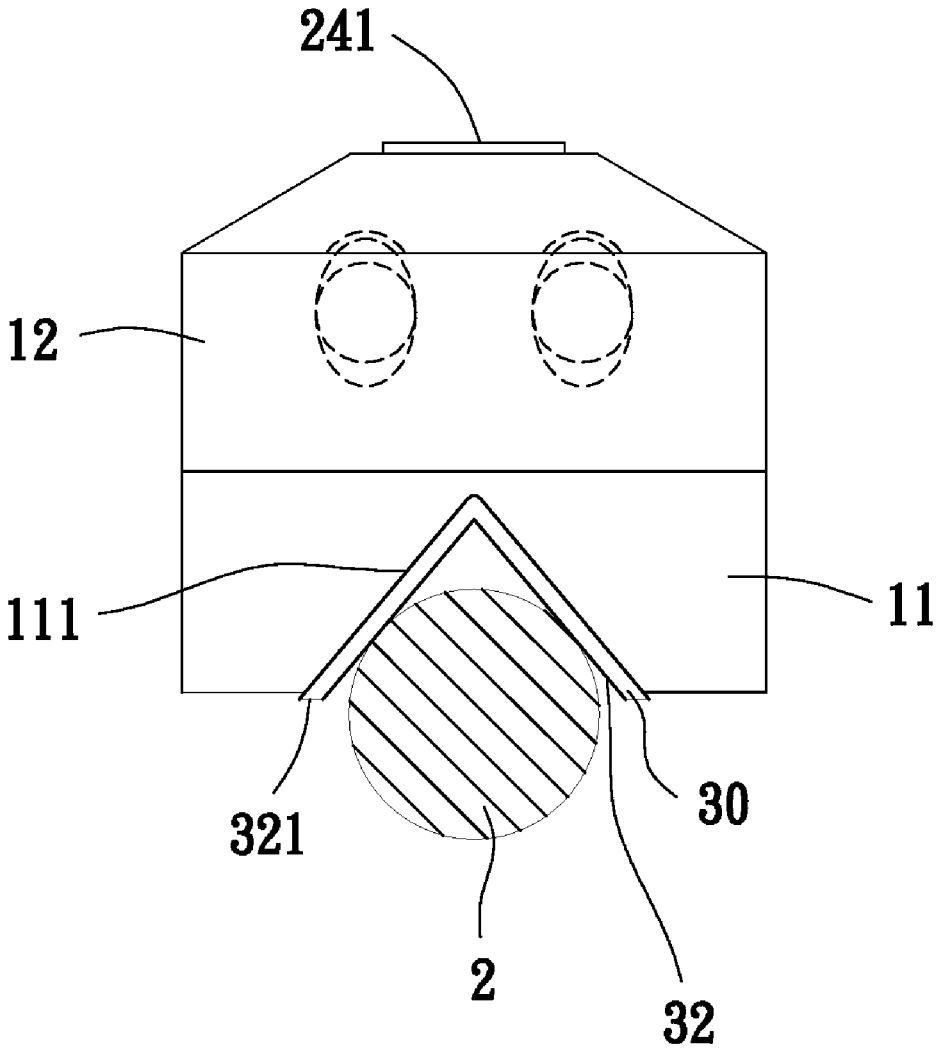
FIG. 7 is a longitudinal sectional view of the illumination device shown in FIG. 5 where a first type of screw driver is secured to the illumination device.
Figure 8:
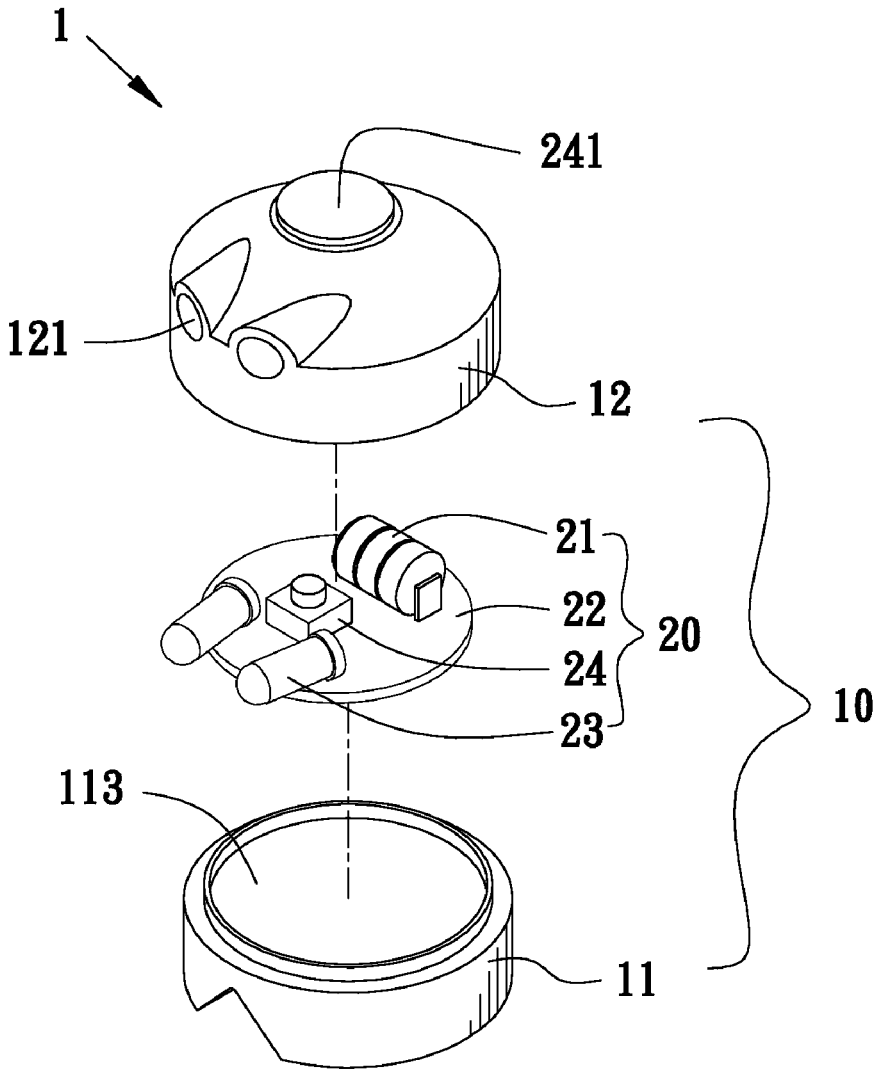
FIG. 8 is an exploded view of a third preferred embodiment of illumination device for tool according to the invention.
Figure 9:
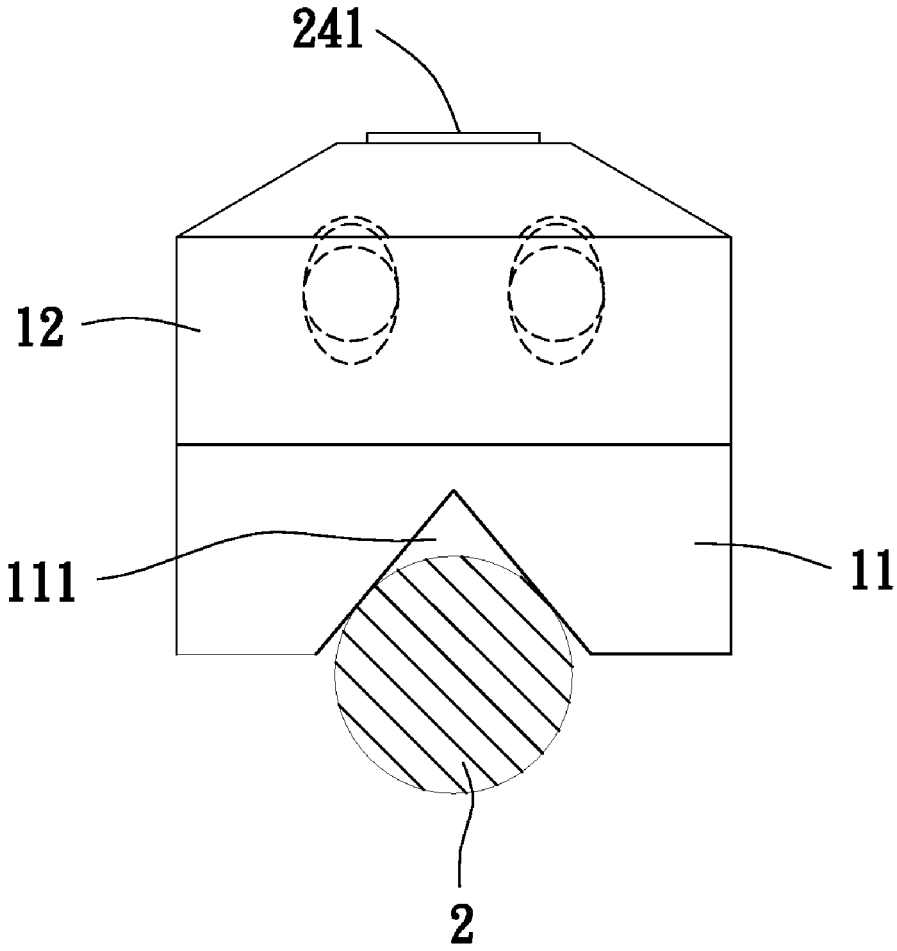
FIG. 9 is a longitudinal sectional view of the illumination device shown in FIG. 8 where a first type of screw driver is secured to the illumination device.

Referring to FIGS. 5 to 7, an illumination device for tool in accordance with a second preferred embodiment of the invention is shown. The second embodiment is identical to the first embodiment, except that the cavity 111 is a perfect inverted V and the magnetic assembly 30 is an integral member, shaped as a ridge, and fixedly secured to the cavity 111. Likewise, the shank of a tool (e.g., screw driver) 2 can be magnetically adhered to the magnetic surfaces 32 of the magnetic assembly 30. Referring to FIGS. 8 and 9, an illumination device for tool in accordance with a third preferred embodiment of the invention is shown. The third embodiment is identical to the second embodiment, except that the magnetic assembly is eliminated and the inverted V-shaped cavity 111 is magnetized. Hence, the shank of a tool (e.g., screw driver) 2 can be magnetically adhered to the cavity 111. The third embodiment has fewer components than both the first and second ones.

Figure 10:
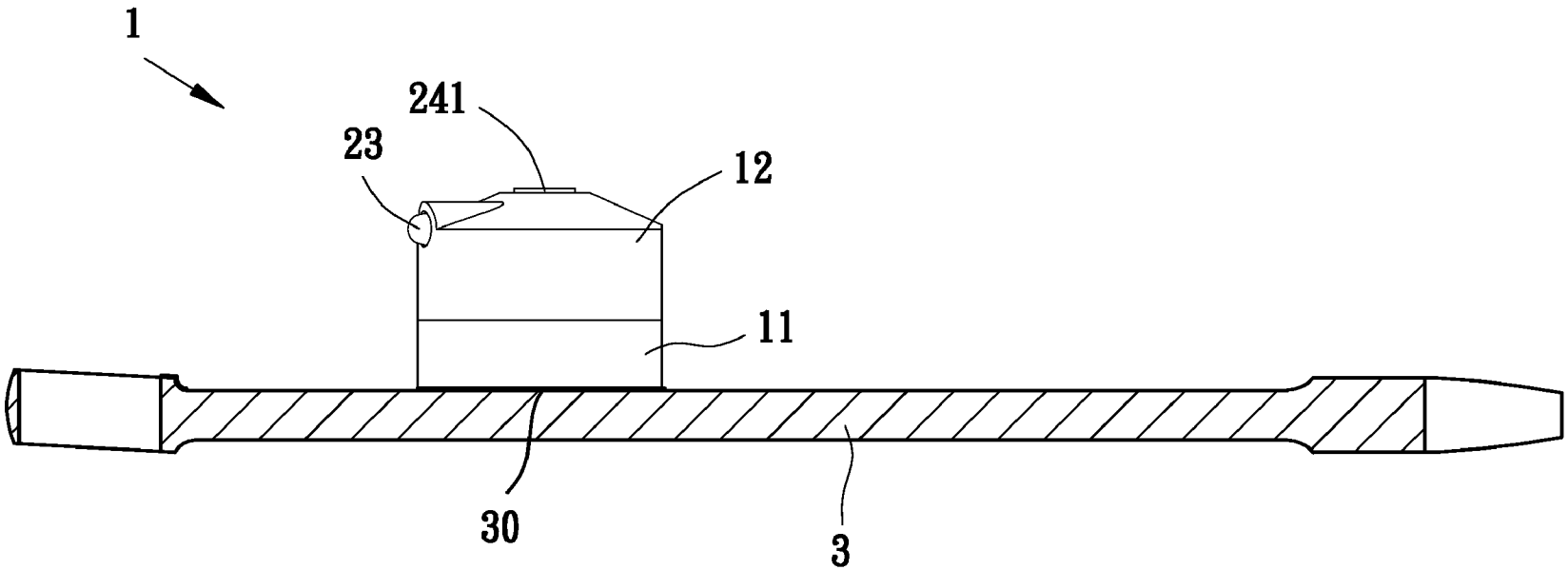
FIG. 10 a schematic side elevation of the illumination device of each of the preferred embodiments being adhered to a wrench.

Referring to FIG. 10, the illumination device 1 of each of the preferred embodiments is adhered to a wrench 3 in another application.

Figure 11:
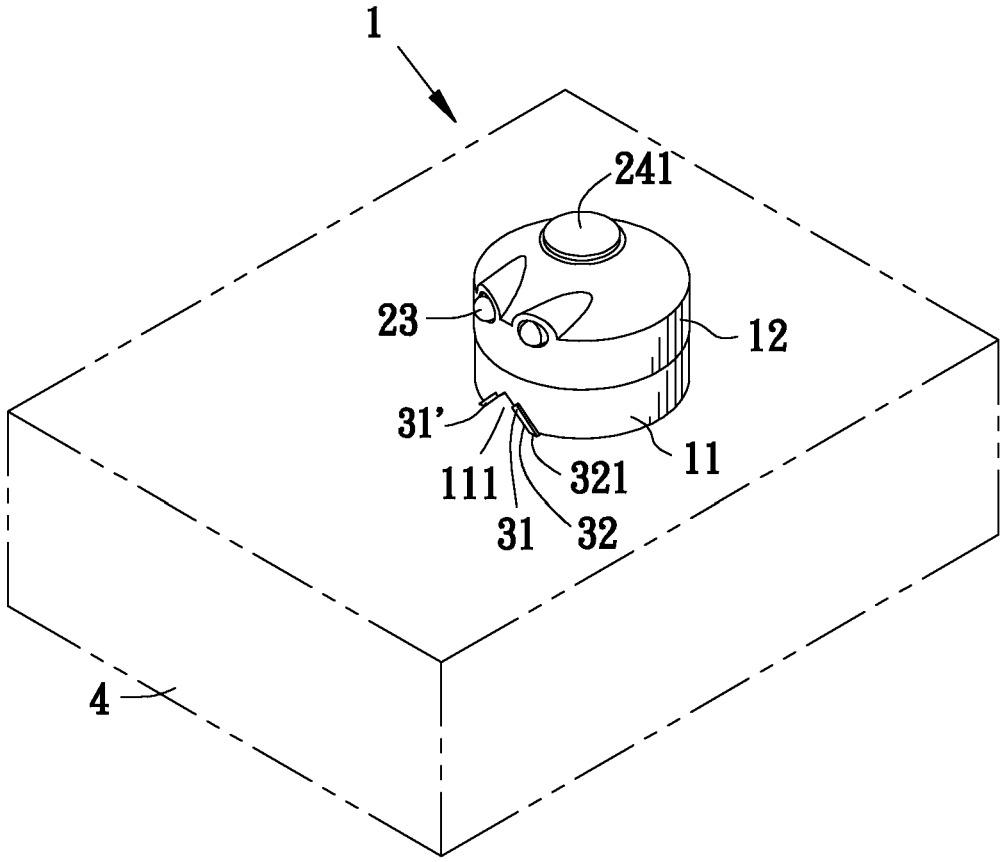
FIG. 11 is a perspective view of the illumination device the first preferred embodiment placed on a flat top of a metal object and magnetically adhered thereto.

Referring to FIG. 11, the illumination device 1 of each of the preferred embodiments, for example, the first preferred embodiment, is stably placed on a flat top of a metal object 4 with the flat bottoms 321 magnetically adhered thereto in still another application.

In view of the above, the invention is adaptable.

While the invention herein disclosed has been described by means of specific embodiments, numerous modifications and variations could be made thereto by those skilled in the art without departing from the scope and spirit of the invention set forth in the claims.

What is claimed is:

1. An illumination device comprising:
a housing comprising a bottom cavity;
a battery powered light emitting assembly disposed in the housing and comprising an exposed light source; and
a magnetic assembly comprising two separate magnetic members each having an inner inclined flat surface, the magnetic members being secured to the cavity.

2. The illumination device of claim 1, wherein the cavity has an inverted V-shape.

3. The illumination device of claim 1, wherein the light source comprises a plurality of LEDs (light-emitting diodes).

4. The illumination device of claim 1, wherein the inner inclined flat surface of each magnetic member has a flat end.

5. An illumination device comprising:
a housing comprising a bottom cavity;
a battery powered light emitting assembly disposed in the housing and comprising an exposed light source; and
a magnetic assembly secured to the cavity.

6. The illumination device of claim 5, wherein the cavity has an inverted V-shape.

7. The illumination device of claim 5, wherein the light source comprises a plurality of LEDs (light-emitting diodes).

8. The illumination device of claim 5, wherein the magnetic assembly has two flat ends.

9. An illumination device comprising:
a housing comprising a magnetic bottom cavity; and
a battery powered light emitting assembly disposed in the housing and comprising an exposed light source.

10. The illumination device of claim 9, wherein the cavity has an inverted V-shape.

11. The illumination device of claim 9, wherein the light source comprises a plurality of LEDs (light-emitting diodes).

12. The illumination device of claim 9, wherein the cavity has two flat ends.

* * * * *